US005655298A

United States Patent [19]

Haen et al.

[11] Patent Number: 5,655,298

[45] Date of Patent: Aug. 12, 1997

[54] METHOD FOR JOINING A TUBE AND A PLATE

[75] Inventors: William G. Haen; Robert Leger, both of Racine, Wis.

[73] Assignee: Greene Manufacturing Co., Sturtevant, Wis.

[21] Appl. No.: 779,423

[22] Filed: Jan. 7, 1997

Related U.S. Application Data

[63] Continuation of Ser. No. 653,761, May 23, 1996, abandoned.

[51] Int. Cl.[6] ..... B23P 15/26

[52] U.S. Cl. ..... 29/890.044; 29/523; 29/890.035

[58] Field of Search ..... 29/890.044, 890.035, 29/523, 890.13, 890.14, 890; 285/222

[56] References Cited

U.S. PATENT DOCUMENTS

| | | | |
|---|---|---|---|
| 2,067,945 | 1/1937 | Peters | 29/890.044 |
| 4,212,099 | 7/1980 | Williams et al. | 29/507 |
| 4,334,703 | 6/1982 | Arthur et al. | 285/222 |
| 4,584,765 | 4/1986 | Gray | 29/727 |
| 4,649,894 | 3/1987 | Hoeffken | 29/890.044 |
| 4,782,571 | 11/1988 | Krips et al. | 29/157.3 |
| 5,004,047 | 4/1991 | Meier et al. | 165/158 |
| 5,101,561 | 4/1992 | Fuhrmann et al. | 29/890.044 |
| 5,341,566 | 8/1994 | Quitschau et al. | 29/890.035 |
| 5,466,016 | 11/1995 | Briody et al. | 285/204 |

FOREIGN PATENT DOCUMENTS

| | | | |
|---|---|---|---|
| 0231337 | 12/1984 | Japan | 29/890.053 |
| 0205212 | 8/1990 | Japan | 29/890.044 |
| 1035402 | 8/1983 | U.S.S.R. | 29/890.044 |

*Primary Examiner*—Irene Cuda
*Attorney, Agent, or Firm*—Jansson & Shupe, Ltd.

[57] ABSTRACT

A method for joining a tube and a plate includes forming a short connection stub which is integral to the plate. The stub is imperforate and has a cylindrical stub surface around the stub circumference and for engaging the tube. The distal stub edge is spaced from the plate and defines a circle. A cylindrical tube has an interior tube surface, an exterior tube surface and a tube end. The tube end is placed in telescoped relationship to the stub and the stub thereby contacts only one of the tube surfaces, i.e., the interior surface or the exterior surface. The tube and stub overlap at a junction. A substantially uniform force is then applied radially around the stub surface and the stub, the edge and the tube are urged simultaneously radially inwardly or outwardly with respect to the axis.

13 Claims, 6 Drawing Sheets

METHOD FOR JOINING A TUBE AND A PLATE

This application is a continuation of application Ser. No. 08/653,761, filed May 23, 1996, now abandoned.

FIELD OF THE INVENTION

This invention is related generally to metal working and, more particularly, to joining two metal components to one another by deforming such components.

BACKGROUND OF THE INVENTION

The broad field of metal working is replete with ways to join two pieces of metal together including joining a metal tube with a non-tubular piece. For example, U.S. Pat. Nos. 4,584,765 (Gray), 4,782,571 (Krips et al.) and 5,004,047 (Meier et al.) all involve joining metal parts to one another to make a heat exchanger.

The joint described in the Krips et al. patent, which involves a relatively-thin-wall tube expanded outwardly against a thick slab, is stated to be "pressure-tight." Welding is used to join the tube and slab.

U.S. Pat. No. 4,212,099 (Williams et al.) describes a method of making a tube-and-plate connection in which an aperture having plural slots is formed in the plate. The metal is then formed into a shallow cup shape having what may be termed a zigzag edge and the fingers are bent back toward the plate. The tube is nested into the fingers and the fingers and tube are crimped together.

U.S. Pat. No. 4,334,703 (Arthur et al.) shows a tube-and-plate connection involving a flange with a tube around the flange. For joining, the side wall of the tube and the flange are both radially, outwardly pierced at one or more places around their circumferences. A stated reason for piercing is to prevent relative rotation of the tube and the flange. Other than at the locations of pierced holes, neither the tube end nor the flange are deformed from their cylindrical shapes. And, of course, piercing destroys any possibility of gas sealing between the tube and flange.

While these prior art approaches to joining a tube and plate have been generally satisfactory for their intended purposes, they are not well suited to join a tube and plate having approximately equal wall thicknesses and requiring a gas-tight seal. Nor are certain of such approaches suitable where protrusion of any structure from but one side of the plate is desired.

The connection described in the Arthur et al. patent pierces the tube and plate at the joint and the method of the Williams et al. patent has protrusions from both side of the plate. It seems doubtful that the Williams et al. method yields a gas-tight seal. Apparently it need not—tubes and plates so joined are used inside a vehicle exhaust muffler surrounded by an outer shell. And the tooling required in the Williams et al. and Arthur et al. methods seems a bit complex.

An improved method for joining a tube and a plate which may be used with tubes and plates having approximately equal wall thicknesses, which results in a protrusion from only one side of the plate, which requires no welding, which is gas-tight and which uses relatively-simple tooling would be an important advance in the art.

OBJECTS OF THE INVENTION

It is an object of this invention to provide an improved method for joining a tube and plate which overcomes some of the problems and shortcomings of devices of the prior art.

Another object of this invention is to provide an improved method for joining a tube and plate which uses relatively-simple tooling.

Another object of this invention is to provide an improved method for joining a tube and plate which results in a gas-tight joint.

Yet another object of this invention is to provide an improved method for joining a tube and plate which is particularly suitable for use with tubes and plates having approximately equal wall thicknesses.

Another object of this invention is to provide an improved method for joining a tube and plate which provides a joined structure with a protrusion to only one side of the plate.

Still another object of this invention is to provide an improved method for joining a tube and plate which is free of welding. How these and other objects are accomplished will become apparent from the following descriptions and from the drawings.

SUMMARY OF THE INVENTION

The new method for joining a tube and a plate to one another includes the steps of forming a short connection stub which is integral to the plate (i.e., formed from the plate "parent" metal) and which extends away from the plate along an axis. The stub is imperforate and has a cylindrical stub surface (an inner or outer surface) around the stub circumference for engaging the tube. The distal stub edge is spaced from the plate and defines a circle.

A cylindrical tube is provided that has an interior tube surface, an exterior tube surface and a tube end. The tube end is placed in telescoped relationship to the stub and the stub thereby contacts only one of the tube surfaces, i.e., the interior surface or the exterior surface. The tube and stub overlap at a junction.

A substantially uniform force is then applied radially around the stub surface, preferably in all directions, i.e., 0°–360° as referenced to a circle. The stub, the edge and the tube are urged simultaneously radially inwardly or outwardly with respect to the axis. During the force-applying and urging steps, the stub and tube are maintained imperforate for gas-tight sealing and the stub is maintained in contact only with that interior or exterior tube surface to which the tube end is telescoped.

A variety of tooling has been found useful in the new method. In one variant of the method, the applying step includes stroking a cylindrical forming pin into the tube toward the plate. The stroking step includes contacting the stub with the pin and urging the stub radially outwardly against the tube distal end.

In another variant of the method, the applying step includes positioning a split collet at the junction and expanding the collet to deform and join the tube and plate. The positioning step may include holding the tube and plate stationary and moving the collet in a first direction into the junction where the tube and stub overlap. The expanding step includes urging an expander tool into the collet in a second direction, i.e., in through the tube toward the junction.

In a more preferred approach, the collet is held stationary and the positioning step includes moving the tube and plate into an overlapping relationship with the collet. The expanding step includes urging an expander tool into the collet through the tube toward the junction.

The expander tool may be a tapered, press-stroked pin which wedges the segments of the collet outwardly. Or such tool may be a hydraulically-pulled expander tool concentric in the collet for wedging the collect segments outwardly.

The method described above contemplates, as one of its aspects, that the stub bend to "pivot" at the annulus where the stub and the plate intersect. But that is not the only aspect of such method. In a variant, the stub is somewhat elongated and the stub surface (that surface which is subjected to radial force) is spaced from the plate. The method includes the step of placing a support tool at a support region between the surface and the plate and in a way that such support tool is axially spaced from the stub edge. The stub and the tube have respective stub and tube portions axially spaced from the support tool and the urging step includes urging the edge and the stub and tube portions radially outwardly.

In other aspects of the new method, the tube and the plate having respective wall thicknesses, the ratio of which is not greater than about 1.5:1. The method includes placing the imperforate end of the tube in overlapping relationship to the stub and deforming the tube engagement surface radially against the end of the tube while retaining the circular edge and while avoiding perforating the stub and the tube.

Deforming may be by stroking a tapered forming pin from the tube second end toward its first end so that the pin contacts the stub and urges such stub radially outwardly against the tube first end. Or deforming may be by positioning a collet at the junction and expanding the collet rim in a way described above.

These and other aspects of the invention are set forth in the following detailed description and in the drawings.

DETAILED DESCRIPTIONS OF THE PREFERRED EMBODIMENTS

Figure 1:
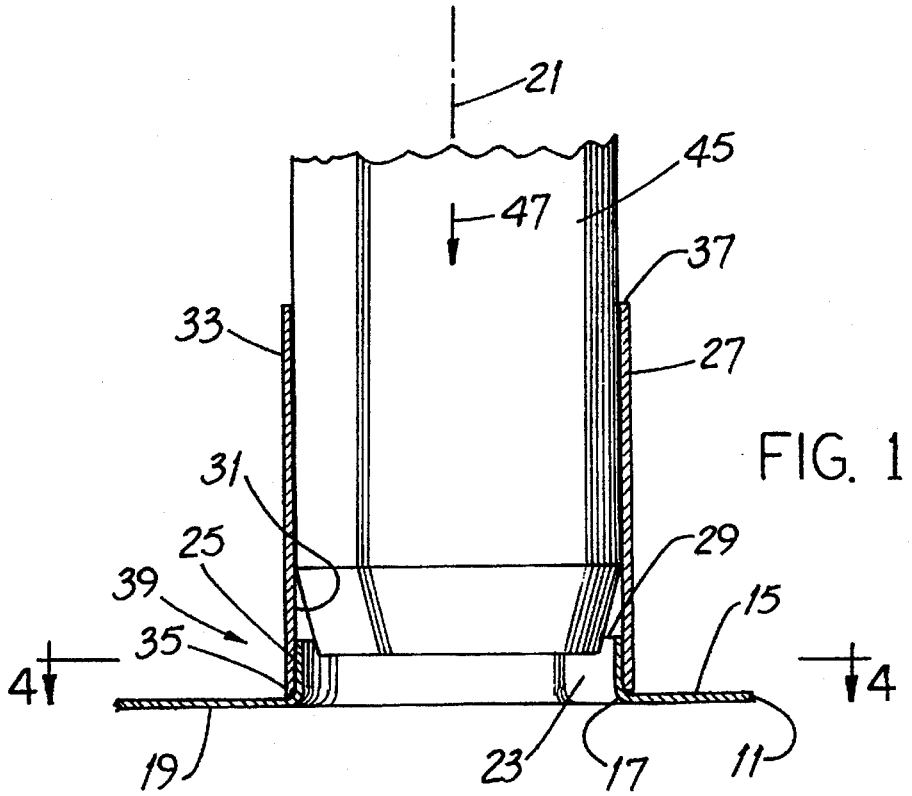
FIG. 1 is an elevation view of a plate, a plate stub and a tube (all in section) to be "deformation-joined" with the stub using a type of expander tool embodied as a tapered pin. Parts are broken away.
Figure 2:
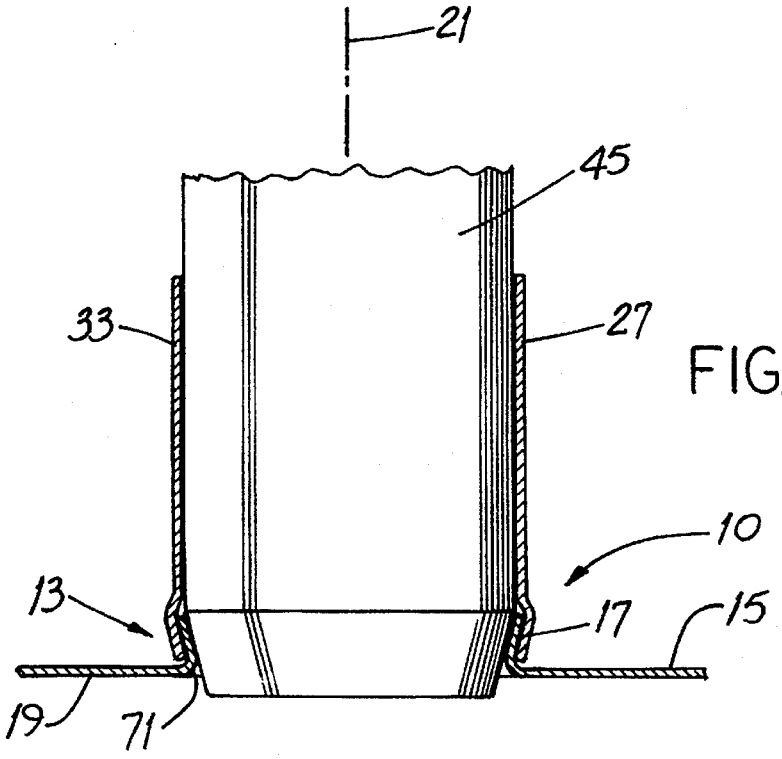
FIG. 2 is an elevation view of the plate, stub and tube (all in section) after the tube and stub are joined by the tapered pin. Parts are broken away.

Referring first to FIGS. 1 and 2, the invention involves the combination 10 of a tube and a plate joined to one another by the new method. The plate 11 is substantially flat (at least at the joint) and has a first side 15 from which a stub 17 protrudes. Tube-plate joining is in such a way that no structure protrudes from the plate second side 19.

The short connection stub 17 is formed from the plate "parent" metal and, therefore, such stub 17 is integral to the plate 11. The stub 17 extends away from the plate 11 along an axis 21.

The stub 17 is imperforate (i.e., free of holes) and has a cylindrical stub surface, i.e., the inner surface 23 or the outer surface 25, around the stub circumference. During joining of the tube 27 and plate 11, one of the surfaces 23 or 25 engages the tube 27. The distal stub edge 29 is circular and is spaced from the plate 11.

The tube 27 has an interior tube surface 31, an exterior tube surface 33 and first and second tube ends 35 and 37, respectively. The tube first end 35 is placed in telescoped relationship to the stub 17 (either around the stub 17 or within the stub 17) and the stub 17 thereby contacts only one of the tube surfaces, i.e., the inner surface 23 or the outer surface 25. The tube 27 and stub 17 overlap at a junction 39.

Figure 4:
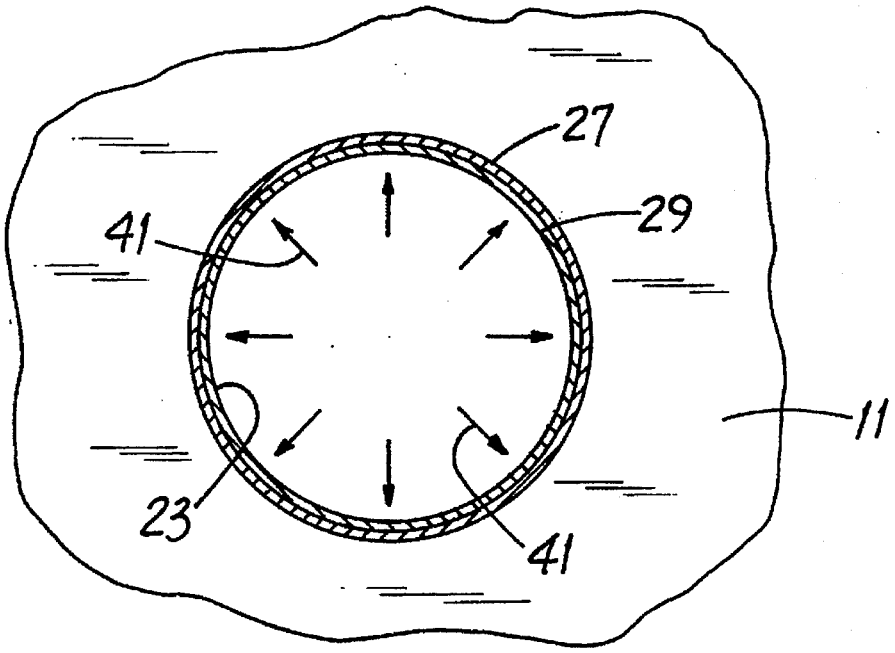
FIG. 4 is a plan view taken along the viewing plane 4—4 of FIG. 1. Parts are broken away.
Figure 3:
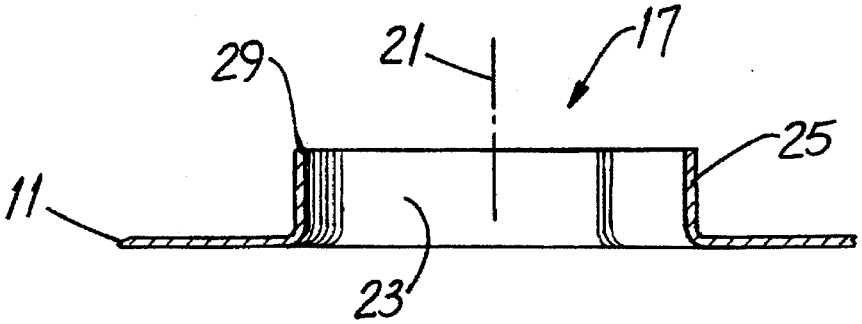
FIG. 3 is an elevation view, in section, of a plate and a stub formed therein.

A substantially uniform force is then applied radially around the stub inner surface 23 as shown in FIG. 4. Such force is preferably applied in all directions, i.e., 0°–360° as referenced to a circle, such directions being outwardly away from the axis as represented by the arrows 41. The stub 17, the stub edge 29 and the tube 27 are urged simultaneously radially outwardly and the sequence is shown in FIGS. 1 and 2. During the force-applying and urging steps, the stub 17 and tube 27 are maintained imperforate for gas-tight sealing and the stub 17 is maintained in contact only with that interior or exterior tube surface 31 or 33, respectively, to which the tube end 35 is telescoped. (FIGS. 1 and 2 show arrangements in which the tube end 35 is outside of and around the stub 17. However, the invention also contemplates the stub 17 being outside of and around the tube end 35.)

A variety of tooling has been found useful in the new method. Referring to FIGS. 1 and 2, in one variant of the method, the applying step includes stroking a cylindrical forming pin 45 into the tube 27 from the tube second end 37 toward the tube first end 35 and toward the plate 11, i.e., in the direction of the arrow 47. The stroking step includes contacting the stub 17 with the pin 45 and urging the stub 17 radially outwardly against the tube first end 35. From the foregoing, it will be appreciated that the diameter of the pin 45 is sized to fit into the tube 27 with slight sliding clearance. It will also be appreciated that the diameter of the pin 45 and the outside diameter of the stub 17 (measured with respect to the stub outer surface 25) are about equal to one another.

Figure 5:
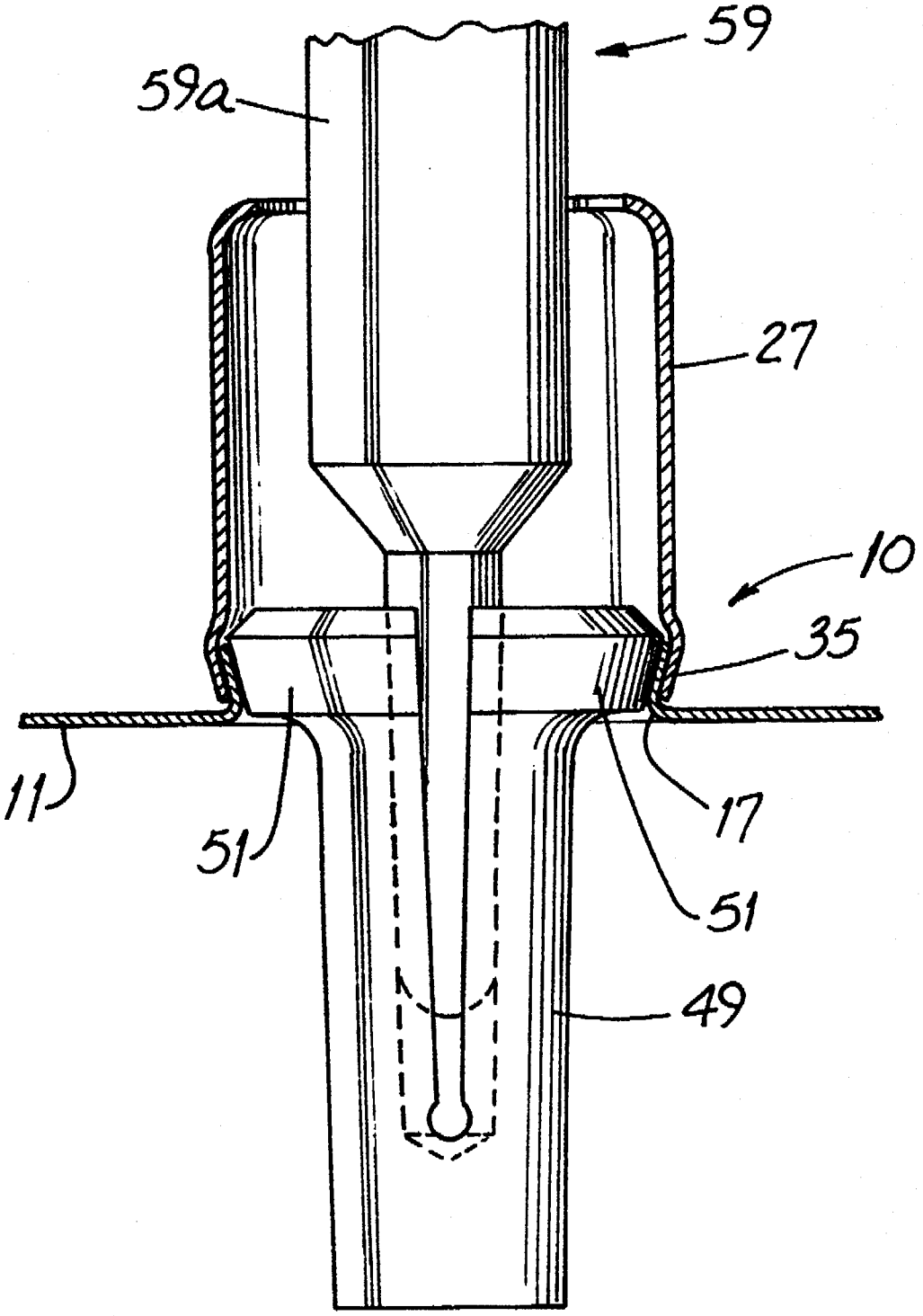
FIG. 5 is an elevation view of the plate, stub and tube (all in section) after the tube and stub are joined by using a collet expanded by using a "stroked" tapered pin. Parts are broken away.
Figure 6:
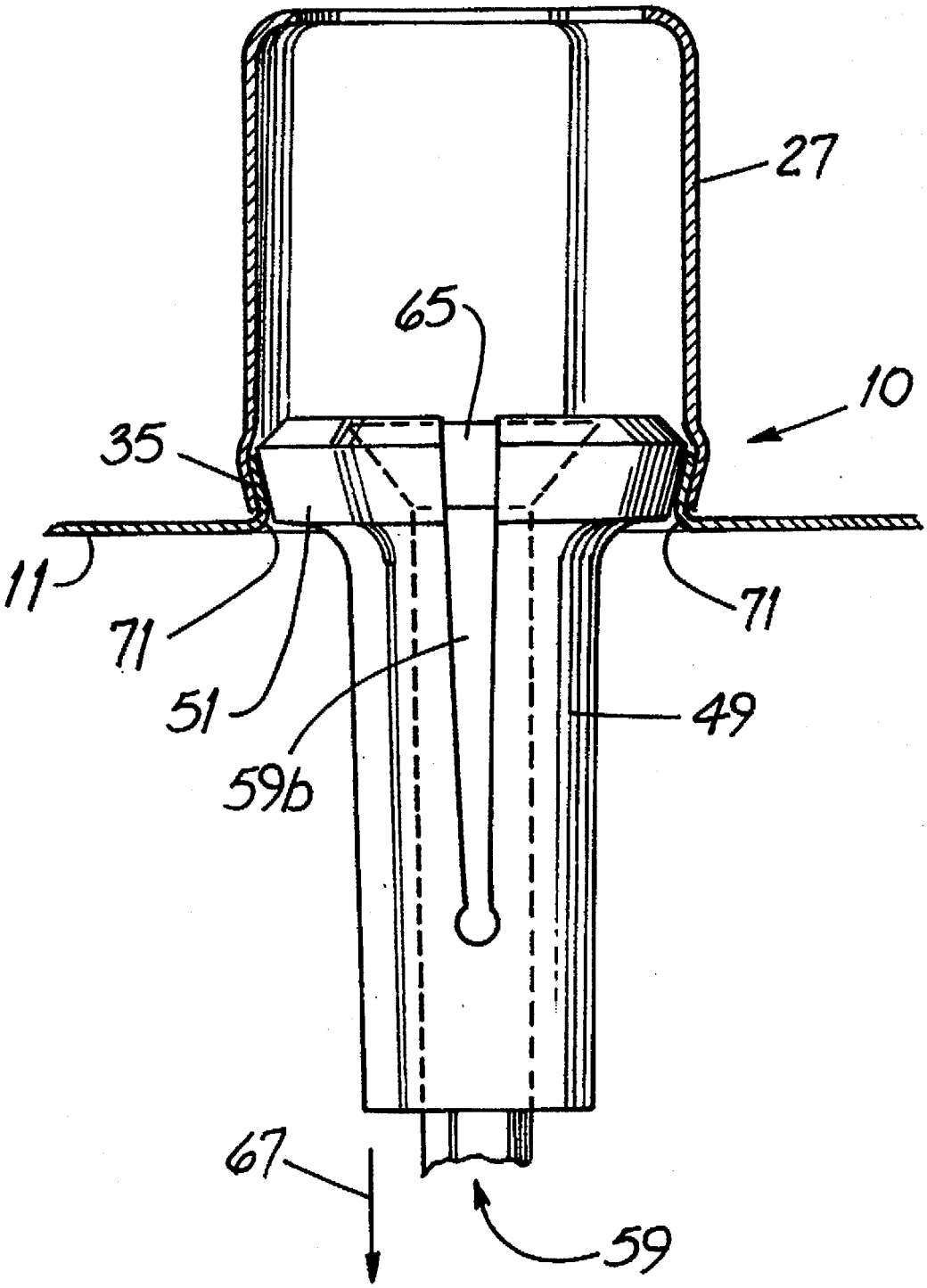
FIG. 6 is an elevation view of the plate, stub and tube (all in section) after the tube and stub are joined by using a collet expanded by using a "pulled" cone-shaped expander tool. Parts are broken away.

Referring next to FIGS. 5, 6, 7 and 8, another variant of the method involves a collet 49, the shape of which is not unlike that of a valve of an internal combustion engine. The collet 49 shown in FIGS. 5 and 6 is longitudinally split to have several arc-shaped segments 51, each of which is capable of radial movement.

Figure 7:
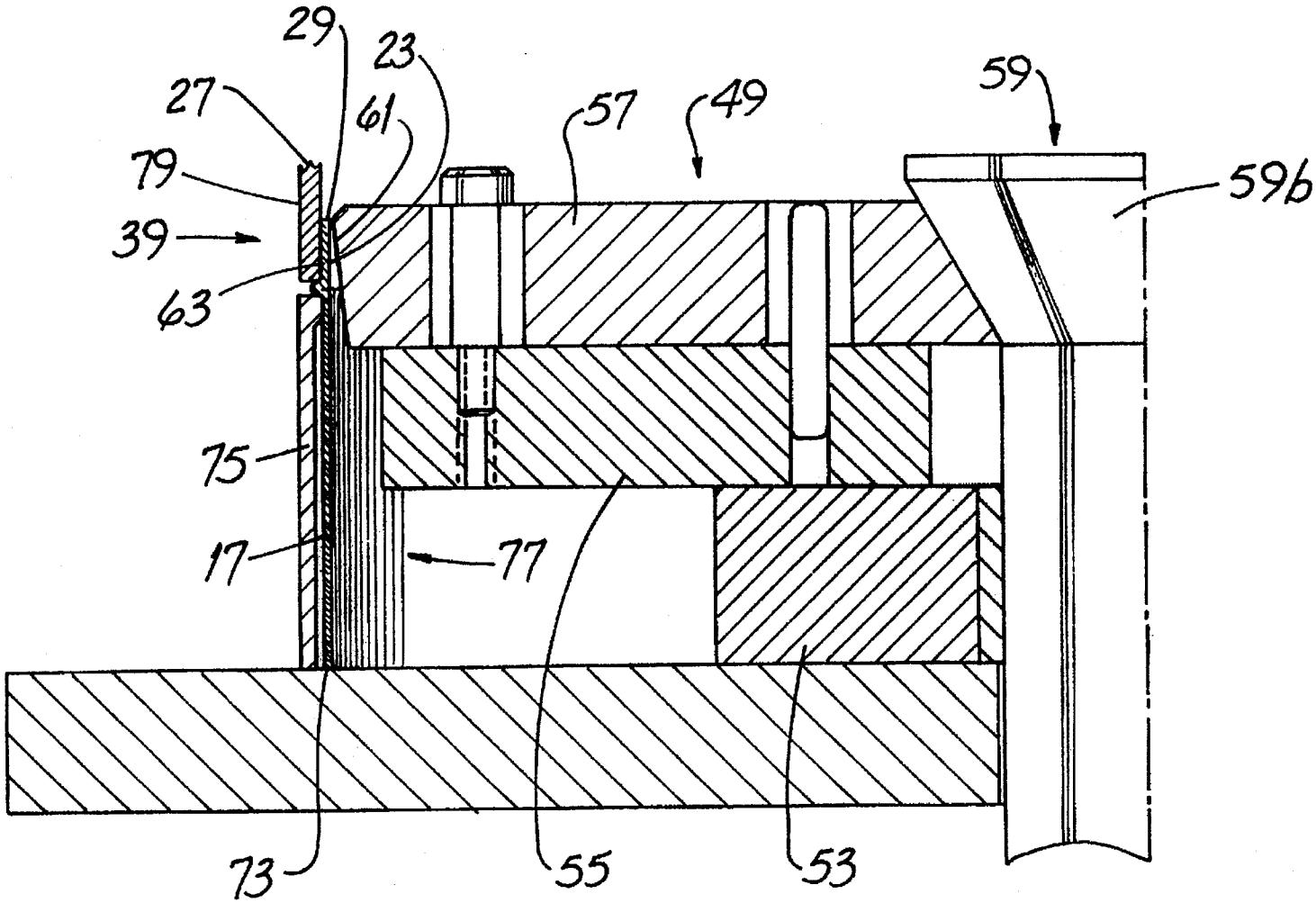
FIG. 7 is a sectional elevation view of a variant approach to joining a tube and stub using another type of collet. The view is about the tube/stub/collet/tool centerline, the collet expander tool is shown in full representation and parts are broken away.
Figure 8:
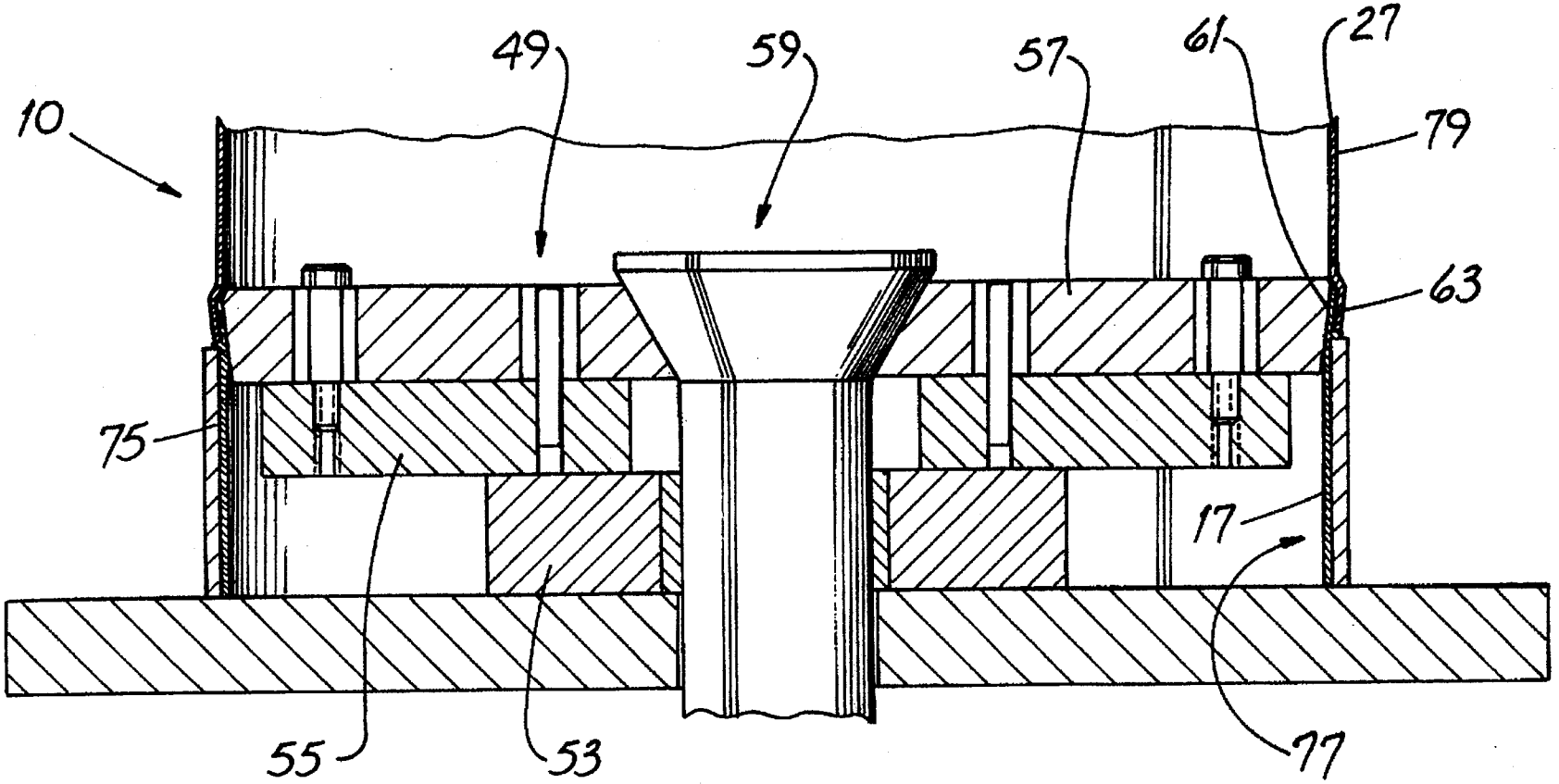
FIG. 8 is a sectional elevation view generally like that of FIG. 7 after the tube and stub have been joined by collet expansion. The collet expander tool is shown in full representation and parts are broken away.

In the embodiment shown in FIGS. 5 and 6, the collet 49 has a relatively-small diameter. In another embodiment of the collet 49 shown in FIGS. 7 and 8, (useful with tubes 27 and stubs 17 which are several inches in diameter), the collet 49 has a post 53, a support plate 55 and a forming plate 57. The forming plate 57 is mounted for sliding movement with respect to the support plate 55 (left-right movement as shown in FIGS. 7, 8) under the urging of the downwardly-pulled expander tool 59. The forming plate 57 has an outer angled face 61 for bending the distal portion 63 of the stub 17.

The applying step includes arranging the tube 27, stub 17 and the collet 49 in overlapping relationship as shown in FIGS. 1 and 7. A preferred way of "setting up" such arrangement includes holding the collet 49 stationary and moving the tube 27 and stub 17/plate 11 to overlap the collet 49 at the junction 39. The collet 49 is then radially expanded to deform and join the tube 27 and plate 11 and, more specifically, to deform and join the tube 27 and the stub 17 extending from and integral with such plate 11.

In a highly preferred approach, the collet 49 is held stationary and the positioning step includes moving the tube 27 and the stub 17 on the plate 11 into an overlapping relationship with the collet 49. The expanding step includes urging an expander tool 59 into the collet 49 through the tube 27 toward the junction 39 as in FIG. 5. In an alternate approach, the arranging step includes moving the collet 49 in a first direction (upwardly in the views of FIGS. 5, 6 into the junction 39 where the tube 27 and stub 17 overlap) and the expanding step includes urging an expander tool 59 into the collet 49 in a second direction, i.e., into the tube 27 toward its second or distal end 37 and toward the junction 39.

As shown in FIG. 5, the expander tool 59 may be a tapered, press-stroked pin 59*a* which wedges the segments 51 of the collet 49 outwardly. Or as shown in FIG. 6, such tool 59 may be a hydraulically-pulled expander tool 59*b* concentric in the collet 49 for wedging the collet segments 51 outwardly. Such tool 59*b* has a head 65 shaped like a truncated cone and is pulled in the direction of the arrow 67.

Referring again to FIGS. 1 and 2, the method contemplates, as one of its aspects, that the stub 17 bends to "pivot" at the annulus 71 where the stub 17 and the plate 11 intersect. Referring again to FIGS. 7 and 8, in a variant of the method, the stub 17 is somewhat elongated and the stub surface 23 (that surface which is subjected to radial force) is spaced from the stub end 73. The method includes the step of placing a ring-like support tool 75 at a support region 77 between the stub end 73 and the stub distal portion 63 and in a way that such support tool 75 is axially spaced from the stub edge 29. The stub 17 and the tube 27 have stub and tube portions 63 and 79, respectively, which are axially spaced from the support tool 75. The urging step includes urging the edge 29 and the stub and tube portions 63, 79 radially outwardly as shown in FIG. 8 to form an imperforate gas-tight joint.

In a more specific method, the tube 27 and the plate 11 have respective wall thicknesses, the ratio of which is not greater than about 1.5:1. The method includes placing the imperforate end 35 of the tube 27 in overlapping relationship to the stub 17 (inside or outside the stub 17) and deforming the tube engagement surface (i.e., surface 23 or 25) of the stub 17 radially against the end 35 of the tube 27 while retaining the circular edge 29 and while avoiding perforating the stub 17 and the tube 27. Deforming may be by, i.e., stroking a tapered forming pin 59*a* or by positioning and expanding a collet 49 as described above.

The new method was developed in response to a need to make a tube connection to a plate 11 as, for example, to a plate 11 used to fabricate a grill gas-feeding device. In such a device, a separate tube 27 is required to be attached when there is sufficient parent metal to "draw" only a short stub 17 and insufficient metal to draw a full-length connection neck.

While the principles of this invention have been described in connection with specific embodiments, it should be understood clearly that these descriptions are made only by way of example and are not intended to limit the scope of the invention. For example, the tube 27 and the stub 17 may be joined by "bulging" such tube 27 and stub 17 radially outwardly or radially inwardly at a location intermediate the annulus 71 and the stub edge 29. Such method is contemplated by the invention.

What is claimed:

1. A method for joining a tube and a plate to one another without the use of welding, such method including the steps of:

forming a stub extending perpendicularly away from the plate along an axis, such stub being imperforate and having (a) a circumferential stub surface, and (b) a distal edge spaced from the plate and defining a circle;

providing a rigid tube extending along and concentric with an axis generally perpendicular to the plate and having an interior tube surface, an exterior tube surface and a tube end;

placing the tube end in telescoped relationship to the stub, the stub thereby contacting only one of the tube surfaces;

applying a substantially uniform force around the stub surface; and simultaneously bending the stub, the edge and only the tube end radially with respect to the axis, the stub being bent to define an acute angle with respect to the plate while maintaining the stub surface imperforate for gas-tight sealing and while maintaining the stub in contact only with the said one of the tube surfaces.

2. The method of claim 1 wherein the tube has an inside diameter and the applying step includes providing a cylindrical forming pin having a diameter slightly less than the inside diameter of the tube, stroking the pin into the tube toward the plate and contacting the stub with the pin.

3. The method of claim 2 wherein the tube includes a tube portion spaced from the end and the stroking step includes urging the stub radially outwardly against the tube end and bending the stub and the tube end while avoiding bending the tube portion.

4. The method of claim 1 wherein the tube and the stub overlap at a junction and the applying step includes:

arranging a collet and the tube and the stub in overlapping relationship;

expanding the collet to bend the stub and the tube end outwardly into a gas-tight sealing relationship with one another; and withdrawing the collet.

5. The method of claim 4 wherein:

the arranging step includes moving the collet in a first direction;

the expanding step includes urging an expander tool into the collet in a second direction; and the withdrawing step includes withdrawing the collet in the second direction.

6. The method of claim 4 wherein:

the arranging step includes holding the collet stationary and moving the tube and stub to overlap the collet at the junction.

7. The method of claim 1 wherein:

the stub surface is spaced from the plate;

and the method includes the step of:

placing a support tool at a support region between the surface and the plate, such support tool being axially spaced from the edge;

and wherein the stub and the tube have respective stub and tube portions axially spaced from the support tool, the urging step includes urging the edge and the stub and tube portions radially outwardly and the method also includes the step of withdrawing the support tool.

8. A method for joining a rigid tube and a plate to one another, the tube extending along and being concentric with an axis generally perpendicular to the plate, the tube having a tube end and a tube portion extending away from the end, the tube and the plate having respective wall thicknesses, the ratio of which is not greater than about 1.5:1, the method including the steps of:

forming an imperforate stub integral to the plate and extending in a direction away from a surface of the plate along an axis, such stub having a circular edge spaced from the plate and a circumferential tube-engagement surface between the edge and the plate;

placing the imperforate end of a tube in overlapping relationship around the stub, such tube end substantially abutting the surface of the plate and having a tube surface against the stub tube-engagement surface;

deforming the entirety of the tube-engagement surface radially against the tube end while retaining the circular edge, while avoiding perforating the stub and the tube, while avoiding bending the tube portion and while maintaining the tube-engaging surface in contact with only the tube surface.

9. The method of claim 8 wherein:

the tube end is a first end;

the tube has a second end;

the tube portion has an inside diameter; and the deforming step includes stroking a forming pin from the second end toward the first end, such forming pin having a diameter not greater than the inside diameter of the tube portion.

10. The method of claim 8 wherein the stroking step includes contacting the stub with the pin and bending the stub and the tube first end radially outwardly to form a gas-tight seal therebetween.

11. The method of claim 8 wherein the tube end and the stub overlap at a junction and the deforming step includes:

providing a collet having a circular rim;

positioning the circular rim at the junction;

expanding the circular rim; and withdrawing the collet.

12. The method of claim 11 wherein:

the positioning step includes moving the collet in the first direction; and the expanding step includes urging an expander tool into the collet in a second direction opposite the first direction.

13. The method of claim 8 wherein:

the engagement surface is spaced from the plate;

and the method includes the step of:

placing a support tool at a support region between the engagement surface and the plate, such support tool being axially spaced from the edge;

and wherein the stub and the tube have respective stub and tube portions axially spaced from the support tool, and the deforming step includes urging the stub and tube portions radially outwardly.

* * * * *